US006565613B1

(12) United States Patent
Winetzky

(10) Patent No.: US 6,565,613 B1
(45) **Date of Patent: *May 20, 2003**

(54) CELLULASE DETERGENT MATRIX

(75) Inventor: Deborah Winetzky, Foster City, CA (US)

(73) Assignee: Genencor International, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/302,035

(22) Filed: Apr. 29, 1999

(51) Int. Cl.[7] ..... D06C 1/12; C11D 1/72; C11D 3/06; C11D 3/10; C11D 3/386

(52) U.S. Cl. ..... 8/137; 510/320; 510/392; 510/393; 510/530; 510/421

(58) Field of Search ..... 510/320, 392, 510/393, 530, 421; 8/137

(56) References Cited

U.S. PATENT DOCUMENTS

| | | | | |
|---|---|---|---|---|
| 5,389,284 A | * | 2/1995 | van der Hoeven et al. | 510/413 |
| 5,635,103 A | * | 6/1997 | Willey et al. | 502/313 |
| 5,635,104 A | * | 6/1997 | Kott et al. | 252/186.1 |
| 5,721,205 A | | 2/1998 | Barnabas et al. | 510/522 |
| 5,759,208 A | * | 6/1998 | Zhen et al. | 8/137 |
| 5,863,887 A | * | 1/1999 | Gillette | 510/520 |
| 5,872,093 A | * | 2/1999 | Convents et al. | 510/475 |
| 5,877,139 A | * | 3/1999 | Casteleijn et al. | 510/303 |

FOREIGN PATENT DOCUMENTS

| | | | | |
|---|---|---|---|---|
| EP | 0120538 A1 | | 3/1984 | |
| EP | 0173397 A2 | | 8/1985 | |
| EP | 0271004 A2 | | 12/1986 | |
| EP | 0269169 A2 | | 11/1987 | |
| EP | 271004 A2 | * | 6/1988 | C11D/3/386 |
| EP | 0365103 A2 | | 10/1989 | |
| EP | 0495257 A1 | | 11/1991 | |
| EP | 0540784 A1 | | 11/1991 | |
| EP | 0495554 A1 | | 1/1992 | |
| EP | 0633311 A1 | | 6/1993 | |
| EP | 0709452 A1 | | 10/1994 | |
| EP | 0679714 A2 | | 4/1995 | |

(List continued on next page.)

OTHER PUBLICATIONS

PCT Search report Jul. 31, 2000.

*Primary Examiner*—Mark Kopec
*Assistant Examiner*—Brian P. Mruk
(74) *Attorney, Agent, or Firm*—Genencor International, Inc.

(57) ABSTRACT

A novel textile treatment composition is provided which comprises a builder which does not comprise a significant portion of zeolite. A novel detergent is provided which comprises the following ingredients: (a) 3–25% of water by weight; (b) 20–50% of an alcohol ethoxylate by weight; (c) 5–30% of soda ash by weight; (d) 20–50% of a phosphate type builder by weight; and (e) an alkaline cellulase. The detergent provides optimum conditions for the activity of the alkaline cellulase on the fabrics in the laundry.

17 Claims, 3 Drawing Sheets

U.S. PATENT DOCUMENTS

| | | | | | |
|---|---|---|---|---|---|
| GB | 2094826 | A | | 3/1982 | |
| GB | 2095275 | A | | 3/1982 | |
| GB | 2 094 826 | | * | 9/1982 | ..... C11D/3/386 |
| GB | 2094826 | A | * | 9/1982 | ..... C11D/3/386 |
| GB | 2307695 | A | | 11/1995 | |
| GB | 2330588 | A | | 10/1997 | |
| WO | WO 90/02790 | | | 3/1990 | |
| WO | WO 92/06154 | | | 4/1992 | |
| WO | WO 93/11215 | | | 6/1993 | |
| WO | WO 96/16153 | | | 5/1996 | |
| WO | WO 97/20025 | | | 6/1997 | |
| WO | WO 97/30143 | | | 8/1997 | |
| WO | WO 97/36985 | | | 10/1997 | |
| WO | WO 97/43381 | | | 11/1997 | |
| WO | WO 97/44294 | | | 11/1997 | |
| WO | WO 98/01521 | | | 1/1998 | |
| WO | WO 98/04663 | | | 2/1998 | |
| WO | WO 98/07821 | | | 2/1998 | |
| WO | WO 98/08926 | | | 3/1998 | |
| WO | WO 98/10136 | | | 3/1998 | |
| WO | WO 98/17769 | | | 4/1998 | |
| WO | WO 98/45396 | | | 10/1998 | |
| WO | WO 99/00478 | | | 1/1999 | |
| WO | WO 99/02637 | | | 1/1999 | |

* cited by examiner

CELLULASE DETERGENT MATRIX

TECHNICAL FIELD

The present invention relates to novel textile laundry treatment formulations, for example, for use in home or institutional laundering compositions. More specifically, the present invention provides for a detergent which comprises an alkaline cellulase which is formulated to achieve optimum activity from the cellulase.

STATE OF THE ART

Cellulases are enzymes which are capable of the hydrolysis of the β-D-glucosidic linkages in celluloses. Cellulolytic enzymes have been traditionally divided into three major classes: endoglucanases, exoglucanases or cellobiohydrolases and β-glucosidases (Knowles, J. et al., (1987), *TIBTECH* 5, 255–261) and are known to be produced by a large number of bacteria, yeasts and fungi.

Primary among the applications that have been developed for the use of cellulolytic enzymes are those involving degrading (wood) cellulose pulp into sugars for (bio)ethanol production, textile treatments like 'stone washing' and 'biopolishing', and in detergent compositions. Thus, cellulases are known to be useful in detergent compositions for removing dirt, i.e., cleaning. For example, Great Britain Application Nos. 2,075,028, 2,095,275 and 2,094,826 illustrate improved cleaning performance when detergents incorporate cellulase. Additionally, Great Britain Application No. 1,358,599 illustrates the use of cellulase in detergents to reduce the harshness of cotton containing fabrics.

Another useful feature of cellulases in the treatment of textiles is their ability to recondition used fabrics by making their colors more vibrant. For example, repeated washing of cotton containing fabrics results in a greyish cast to the fabric which is believed to be due to disrupted and disordered fibrils, sometimes called "pills", caused by mechanical action. This greyish cast is particularly noticeable on colored fabrics. As a consequence, the ability of cellulase to remove the disordered top layer of the fiber and thus improve the overall appearance of the fabric has been of value.

Because detergents, being a primary application of cellulase, operate generally under alkaline conditions there is a strong demand for cellulases which have excellent activity at pH 8–11.5. Well characterized fungal cellulases, such as those from *Humicola insolens* and *Trichoderna reesei*, perform adequately at neutral to low alkaline pH. However, a number of enzymes that show cellulase activity at high alkaline pH have been isolated from Bacillus and other prokaryotes, see e.g., EP Publication Nos. 468 464 and EP 510 091, PCT Publication Nos. WO 93/12224, WO 96/34092 and WO 96/34108. Cellulases isolated from Actinomycetes, have also attracted some attention. Wilson et al., *Critical Reviews in Biotechnology*, Vol. 12, pp. 45–63 (1992), studied the cellulases produced by the *Thermomonospora fusca, Thermonomospora curvata and Microbispora bispora* and illustrated that many of these cellulases show broad pH profiles and good temperature stability. Similarly, Nakai et al., *Agric. Biol. Chem.*, Vol. 51, pp. 3061–3065 (1987) and Nakai et al., *Gene*, Vol. 65, pp. 229–238 (1988) exemplify the alkalitolerant cellulase casA from Streptomyces strain KSM-9 which also possesses an alkaline pH optimum and excellent temperature stability. Thus, both fungal and bacterial cellulases have been investigated thoroughly.

EP Publication No. 173 397 discloses detergent compositions comprising a cationic softening agent and a fungal cellulolytic enzyme.

EP Publication No. 269 168 (Proctor & Gamble) describes a detergent composition which comprises a surface active agent of which at least 50% is an anionic surfactant and a cellulase, which has a pH, in 1% distilled water, of from 6.5 to 9.5 and are essentially free of long chain alkyl amine softening agents, or derivatives thereof.

EP Publication No. 269 169 describes a detergent composition which comprises 0.1% to 1% of an alkoxylated polyamine, and in that the pH of a 1% solution of the detergent compositions in distilled water is from 6.5 to 9.5.

EP Publication No. 320 296 describes softening additives for detergent compositions comprising a water soluble nonionic ethyl hydroxyethyl cellulose having an HLB of 3.3 to 3.8, a dp of 50 to 1200 and a ds of 1.9 to 2.9. Enzymes including cellulolytic enzymes are disclosed.

EP Publication No. 383 828 describes a granular detergent composition containing a fabric softening clay material, and cellulase granulates containing from 1% to 50%, by weight, preferably 5% to 15% of the granulates, of calcium carbonate.

PCT Publication No WO 96/20997 discloses a detergent composition comprising at least 1% of a surfactant system, characterized in that the system comprises a nonionic polysaccharide ether having a 1,4 β-glucosidic bond, a degree of polymerization of 100 or more and a degree of substitution of from 0.5 to 2.8 inclusive of mixtures thereof, in combination with a cellulolytic enzyme.

PCT Publication No. 97/32958 describes an aqueous surfactant composition comprising (1) 1–5% of a surfactant selected from the group consisting of anionic, nonionic, cationic, zwitterionic and amphoteric surfactants and mixtures thereof; (2) a ternary system for stabilizing system for stabilizing Endoglucanase III comprising (a) 0.1–10% water soluble hydrophobic nonionic polymer; (b) 5–25% of a $C_2$–$C_6$ allkylene glycol; and (c) 0.1–7% of a hydrophilic amine; and (3) a cellulase comprising 0.001–5.0% by wt of Endoglucanase III or variants thereof, wherein the fatty acid content is below about 5%.

PCT Publication No. 96/12781 describes a detergent composition comprising (a) a surfactant selected from anionic, nonionic, cationic, amphoteric and zwitterionic detergent-active compounds and mixtures thereof; (b) a detergency builder comprising zeolite P having a silicon to aluminum ratio not greater than 1.33 (zeolite MAP); and (c) a cellulolytic enzyme.

Despite the extent of previous work in the field of cellulases, the industry continues to seek new and improved formulations of and methods of delivering cellulase compositions to target applications. Pursuant to their research, the inventors herein have discovered that certain formulations of builder and detergent are optimal for alkaline cellulases.

SUMMARY OF THE INVENTION

It is an object of the invention to provide for a textile treatment composition comprising an alkaline cellulase, which composition has improved characteristics.

It is a further object of the invention to provide for a textile treatment composition comprising an alkaline cellulase, which composition facilitates improved performance of the cellulase.

According to the invention, a textile treatment composition comprising an alkaline cellulase is provided, wherein a builder is included which does not comprise a substantial amount of zeolite. Preferably the builder is an phosphate type builder.

Also according to the invention, a composition for treating textiles is provided comprising: (a) 3–25% by weight water; (b) 20–50% by weight alcohol ethoxylate; (c) 5–30% by weight soda ash; (d) 20–50% by weight phosphate type builder; and (e) an alkaline cellulase. Preferably, the composition further comprises a pH of between 8 and 11.5 upon dilution in a wash liquor. Also preferably, the alkaline cellulase is of bacterial origin, most preferably from Bacillus or Actinomyces.

In a particularly preferred embodiment of the invention, the textile treatment composition comprises a detergent and is used in the laundering of soiled clothing. In yet another particularly preferred embodiment of the invention, the textile treatment composition comprises a stonewashing composition for the stonewashing of cellulose containing fabrics. In yet another embodiment of the invention, the textile treatment composition comprises a pre-wash composition. In yet another embodiment, the textile treatment composition comprises a laundry softening composition.

In another embodiment of the invention, a method is provided for treating a textile, comprising obtaining a textile treatment composition comprising (a) 3–25% water; (b) 20–50% alcohol ethoxylate; (c) 5–30% soda ash; (d) 20–50% of an phosphate type builder; and (e) an alkaline cellulase, adding said composition to water to produce an aqueous laundry bath and contacting said laundry bath with soiled laundry.

In yet another embodiment of the invention, a method of treating textiles is provided comprising the steps of: (a) preparing an aqueous solution; (b) adding to said aqueous solution a textile treatment composition comprising: (i) 3–25% water; (ii) 20–50% alcohol ethoxylate; (iii) 5–30% soda ash; (iv) 20–50% phosphate type builder; and (v) an alkaline cellulase to make a textile treatment solution; (c) adding a textile garment, yam or fabric to the textile treatment solution and allowing the textile treatment solution to contact the garment, yam or fabric for a sufficient time and under sufficient conditions to treat the textile garment, yam or fabric. Preferably the textile comprises a cellulosic material, more preferably a cotton containing material.

DETAILED DESCRIPTION OF THE INVENTION

Figure 1:
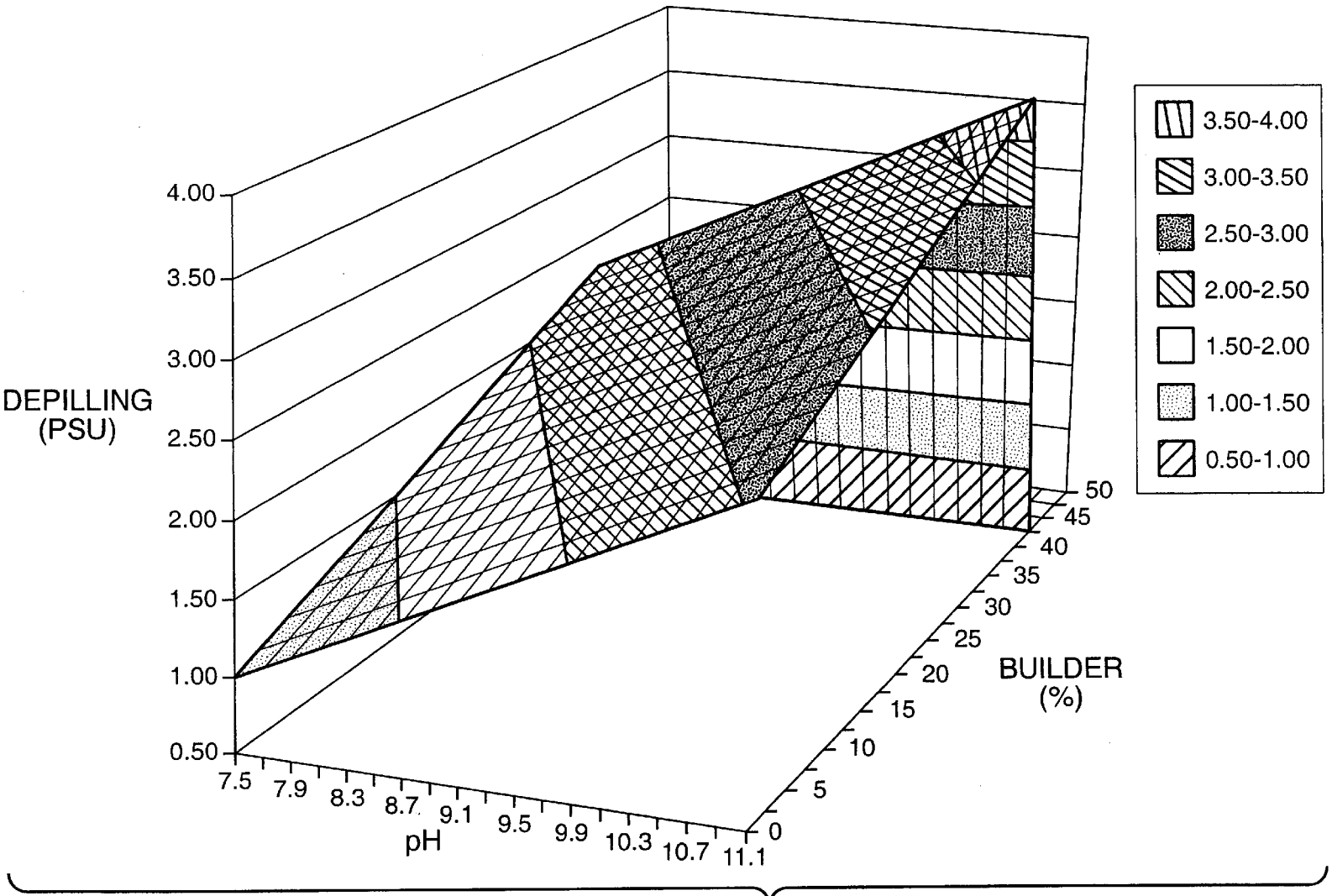
FIG. 1 shows the effect of pH and zeolite type builder on depilling.

"Cotton-containing fabric" means sewn or unsewn garments, yarns or fibers made of pure cotton or cotton blends including cotton woven fabrics, cotton knits, cotton denims, cotton yams and the like. When cotton blends are employed, the amount of cotton in the fabric is preferably at least about 35 percent by weight cotton. When employed as blends, the companion material employed in the fabric can include one or more non-cotton fibers including synthetic fibers such as polyamide fibers (for example, nylon 6 and nylon 66), acrylic fibers (for example, polyacrylonitrile fibers), and polyester fibers (for example, polyethylene terephthalate), polyvinyl alcohol fibers (for example, Vinylon), polyvinyl chloride fibers, polyvinylidene chloride fibers, polyurethane fibers, polyurea fibers and aramid fibers.

"Cellulose containing fabric" means any sewn or unsewn garments, yams or fibers which contain cotton or non-cotton containing cellulose or cotton or non-cotton containing cellulose blends including natural cellulosics and manmade cellulosics (such as jute, flax, ramie, rayon, and lyocell). Included under the heading of manmade cellulose containing fabrics are regenerated fabrics that are well known in the art such as rayon. Other manmade cellulose containing fabrics include chemically modified cellulose fibers (e.g, cellulose derivatized by acetate) and solvent-spun cellulose fibers (e.g. lyocell). Specifically included within the definition of cellulose containing fabric is any yam or fiber made of such materials.

"Stonewashing" means the treatment of cellulose containing fabric with a cellulase solution under agitating and cascading conditions, i.e., in a rotary drum washing machine, to impart a "stonewashed" appearance to the denim. The cellulase solution according to the instant invention will functionally replace the use of stones in such art recognized methods, either completely or partially. Methods for imparting a stonewashed appearance to denim are described in U.S. Pat. No. 4,832,864 which is incorporated herein by reference in its entirety. Generally, stonewashing techniques have been applied to indigo dyed denim.

"Phosphate type builder" means a salt which sequesters water hardness causing polyvalent metal ions, such as the sodium tripolyphosphate (STPP) used in the formulation. Other phosphate builders used in the detergent industry can be divided into two classes: orthophosphates and condensed or complex phosphates. The orthophosphates include trisodium or tripotassium phosphate and disodium or tripotassium phosphate. The condensed phosphated include tetrasodium pyrophosphate, sodium tripolyphosphate, sodium tetraphosphate, and sodium hexametaphosphate. All of these compounds have the further ability to redissolve insoluble salts of the water hardness metals, to deflocculate the wash liquor, and to buffer the wash liquor. Such builders are described in, for example, *Synthetic Detergents*, 7th edition, A. S Davidsohn and B. M. Milwidsky, Longman Scientific & Technical publishers, 1987, pp 48–54. By contrast, "zeolite type builders" comprise a mineral that binds water hardness causing polyvalent metal ions, especially calcium, via ion exchange. Zeolites are crystalline aluminosilicates with a cage structure which have the further ability to remove soluble metals ions, e.g. magnesium, manganese and iron, from the wash liquor. (reference: "Zeolites and the Environment: The year 2000", by Howard S. Sherry, Richard T. Coffee, and Thomas H. Gudowicz, reprint from the *2nd World Chemical Congress*, Sept. 13–16, 1992)

Treatment of textiles according to the present invention contemplates textile processing or cleaning with the textiles treatment composition according to the invention. According to the invention, a textile treatment composition comprising an alkaline cellulase is provided, wherein a builder is included which does not comprise a substantial amount of zeolite. Preferably the builder is a phosphate type builder. A substantial amount of zeolite means that amount which significantly effects the specific alkaline celullase included within the composition. Such "substantial" amount will thus vary according to the amount, type, and nature of the cellulase, but will be readily ascertained by the skilled worker in the field.

Also according to the invention, a composition for treating textiles is provided comprising: (a) 3–25% by weight water; (b) 20–50% by weight alcohol ethoxylate; (c) 5–30% by weight soda ash; (d) 20–50% by weight phosphate type builder; and (e) an alkaline cellulase. Preferably, the composition further comprises a pH of between 8 and 11.5 upon dilution in a wash liquor. Also preferably, the alkaline cellulase is of bacterial origin, most preferably from Bacillus or Actinomyces. In a further preferred embodiment, the amount of water may be from 5–20%, most preferably from 5–15%. In yet another preferred embodiment, the amount of alcohol ethoxylate is from 25–45%, most preferably from 30–40%. In yet another preferred embodiment, the amount of soda ash is from 10–25%, most preferably from 15–20%. In yet another preferred embodiment, the amount of phosphate type builder is from 25–40%, most preferably from 30–40%.

In a particularly preferred embodiment of the invention, the textile treatment composition comprises a detergent and is used in the laundering of soiled clothing. In yet another particularly preferred embodiment of the invention, the textile treatment composition comprises a stonewashing composition for the stonewashing of cellulose containing fabrics. In yet another embodiment of the invention, the textile treatment composition comprises a pre-wash composition. In yet another embodiment, the textile treatment composition comprises a laundry softening composition.

In another embodiment of the invention, a method is provided for treating a textile, comprising obtaining a textile treatment composition comprising (a) 3–25% water; (b) 20–50% alcohol ethoxylate; (c) 5–30% soda ash; (d) 20–50% of an phosphate type builder; and (e) an alkaline cellulase, adding said composition to water to produce an aqueous laundry bath and contacting said laundry bath with soiled laundry. In a further preferred embodiment, the amount of water may be from 5–20%, most preferably from 5–15%. In yet another preferred embodiment, the amount of alcohol ethoxylate is from 25–45%, most preferably from 30–40%. In yet another preferred embodiment, the amount of soda ash is from 10–25%, most preferably from 15–20%. In yet another preferred embodiment, the amount of phosphate type builder is from 25–40%, most preferably from 30–40%.

In yet another embodiment of the invention, a method of treating textiles is provided comprising the steps of: (a) preparing an aqueous solution; (b) adding to said aqueous solution a textile treatment composition comprising: (i) 3–25% water; (ii) 20–50% alcohol ethoxylate; (iii) 5–30% soda ash; (iv) 20–50% phosphate type builder; and (v) an alkaline cellulase to make a textile treatment solution; (c) adding a textile garment, yarn or fabric to the textile treatment solution and allowing the textile treatment solution to contact the garment, yam or fabric for a sufficient time and under sufficient conditions to treat the textile garment, yam or fabric. Preferably the textile comprises a cellulosic material, more preferably a cotton containing material. In a further preferred embodiment, the amount of water may be from 5–20%, most preferably from 5–15%. In yet another preferred embodiment, the amount of alcohol ethoxylate is from 25–45%, most preferably from 30–40%. In yet another preferred embodiment, the amount of soda ash is from 10–25%, most preferably from 15–20%. In yet another preferred embodiment, the amount of phosphate type builder is from 25–40%, most preferably from 30–40%.

Treating according to the present invention includes, but is not limited to, stonewashing, modifying the texture, feel and/or appearance of cellulose containing fabrics or other techniques used during manufacturing or cleaning/reconditioning of cellulose containing fabrics. Additionally, treating within the context of this invention contemplates the removal of "immature" or "dead" cotton from cellulosic fabric or fibers. Immature cotton is significantly more amorphous than mature cotton and results in a lesser quality fabric when present due to, for example, uneven dyeing. The composition contemplated in the present invention further includes an alkaline cellulase component for use in washing of a soiled manufactured cellulose containing fabric. For example, the cellulase may be used in a detergent composition for washing laundry. Detergent compositions useful in accordance with the present invention include special formulations such as pre-wash, pre-soak and home-use color restoration compositions. Such treating compositions, as described herein, may be in the form of a concentrate which requires dilution or in the form of a dilute solution or form which can be applied directly to the cellulose containing fabric. General treatment techniques for cellulase treatment of textiles are described in, for example, EP Publication No. 220 016 and GB Application Nos. 1,368,599 and 2,095,275.

Cellulases of use in the present invention are alkaline cellulases, i.e., those which are capable of providing an effect on cotton or cellulose containing fabric in the pH range of 8–11.5. Examples of such cellulases include many such cellulases from bacterial sources, such as Bacillus, Actinomycete or other known alkaline cellulases. Examples of other alkaline cellulases from bacterial origin are provided in, for example, U.S. Pat. No. 4,978,470 (Suzuki et al.), 4,945,053 (Ito et al.), 4,443,355 (Murata et al.) and 5,045,464 (Ito et al.), EP Publication Nos. 468 464 and EP 510 091, and PCT Publication Nos. WO 93/12224, WO 96/34092 and WO 96/34108, the disclosures of which are herein incorporated by reference. In addition, alkaline cellulases may be obtained from fungal sources. Additionally, alkaline cellulases may be genetically engineered from non-alkaline cellulases by modifying the protein to result in an increase to the pH profile to the alkaline range.

An effective amount of cellulase enzyme composition is a concentration of cellulase enzyme sufficient for its intended purpose. Thus, for example, an "effective amount" of cellulase in a stonewashing composition according to the present invention is that amount which will provide the desired effect, e.g., to produce a worn and faded look in the seams and on fabric panels. Similarly, an "effective amount" of cellulase in a composition intended for improving the feel and/or appearance of a cellulose containing fabric is that amount which will produce measurable improvements in the feel, e.g., improving the smoothness of the fabric, or appearance, e.g., removing pills and fibrils which tend to reduce the sharpness in appearance of a fabric. The amount of cellulase employed is also dependent on the equipment employed, the process parameters employed (the temperature of the cellulase treatment solution, the exposure time to the cellulase solution, and the like), and the cellulase activity (e.g., a particular solution will require a lower concentration of cellulase where a more active cellulase composition is used as compared to a less active cellulase composition). The exact concentration of cellulase in the aqueous treatment solution to which the fabric to be treated is added can be readily determined by the skilled artisan based on the above factors as well as the desired result. In stonewashing processes, it has generally been preferred that the cellulase be present in the aqueous treating solution in a concentration of from about 0.5 to 5,000 ppm and most preferably about 10 to 200 ppm total protein. In compositions for the improvement of feel and/or appearance of a cellulose containing fabric, it has generally been preferred that the cellulase be present in the aqueous treating solution in a concentration of from about 0.1 to 2000 ppm and most preferably about 0.5 to 200 ppm total protein.

In a preferred treating embodiment, a buffer is employed in the treating composition such that the concentration of buffer is sufficient to maintain the pH of the solution within the range wherein the employed cellulase exhibits activity which, in turn, depends on the nature of the cellulase employed. The exact concentration of buffer employed will depend on several factors which the skilled artisan can readily take into account. For example, in a preferred embodiment, the buffer as well as the buffer concentration are selected so as to maintain the pH of the final cellulase solution within the pH range required for optimal cellulase activity. The determination of the optimal pH range of the alkaline cellulases of the invention can be ascertained according to well known techniques. Suitable buffers at pH within the activity range of the alkaline cellulase are well known to those skilled in the art in the field.

In addition to cellulase and a buffer, the treating composition may comprise as provided herein a surfactant, a builder and soda ash. Suitable surfactants include any those provided in, for example, PCT Publication No. WP 97/43381 (Proctor & Gamble), provided that, however, the concentration of alcohol ethoxylate is between 20–50%.

Other materials can also be used with or placed in the cellulase composition of the present invention as desired, including stones, pumice, fillers, solvents, enzyme activators, and anti-redeposition agents depending on the eventual use of the composition.

According to yet another preferred embodiment of the present invention, the cellulase of the invention may be employed in a detergent composition. The detergent compositions according to the present invention are useful as pre-wash compositions, pre-soak compositions, or for cleaning during the regular wash or rinse cycle.

An effective amount of cellulase employed in the detergent compositions of this invention is an amount sufficient to impart the desirable effects known to be produced by cellulase on cellulose containing fabrics, for example, depilling, softening, anti-pilling, surface fiber removal, anti-graying and cleaning. Preferably, the cellulase in the detergent composition is employed in a concentration of from about 5 ppm to about 20,000 ppm of detergent.

The concentration of cellulase enzyme employed in the detergent composition is preferably selected so that upon dilution into a wash medium, the concentration of cellulase enzyme is in a range of about 0.001 to about 1000 ppm, preferably from about 0.01 ppm to about 500 ppm, and most preferably from about 0.5 ppm to about 250 ppm total protein. The amount of cellulase enzyme employed in the detergent composition will depend on the extent to which the detergent will be diluted upon addition to water so as to form a wash solution.

The detergent compositions of the present invention may be in any art recognized form, for example, as a liquid, in granules, in emulsions, in gels, or in pastes. Such forms are well known to the skilled artisan. When a solid detergent composition is employed, the cellulase is preferably formulated as granules. Preferably, the granules can be formulated so as to additionally contain a cellulase protecting agent. The granule can be formulated so as to contain materials to reduce the rate of dissolution of the granule into the wash medium. Such materials and granules are disclosed in U.S. Pat. No. 5,254,283 which is incorporated herein by reference in its entirety.

The detergent compositions of this invention may employ additional ingredients as follows:

Hydrolases Except Cellulase

Suitable hydrolases include carboxylate ester hydrolase, thioester hydrolase, phosphate monoester hydrolase, and phosphate diester hydrolase which act on the ester bond; glycoside hydrolase which acts on glycosyl compounds; an enzyme that hydrolyzes N-glycosyl compounds; thioether hydrolase which acts on the ether bond; and a-amino-acyl-peptide hydrolase, peptidyl-amino acid hydrolase, acyl-amino acid hydrolase, dipeptide hydrolase, and peptidyl-peptide hydrolase which act on the peptide bond. Preferable among them are carboxylate ester hydrolase, glycoside hydrolase, and peptidyl-peptide hydrolase. Suitable hydrolases include (1) proteases belonging to peptidyl-peptide hydrolase such as pepsin, pepsin B, rennin, trypsin, chymotrypsin A, chymotrypsin B, elastase, enterokinase, cathepsin C, papain, chymopapain, ficin, thrombin, fibrinolysin, renin, subtilisin, aspergillopeptidase A, collagenase, clostridiopeptidase B, kallikrein, gastrisin, cathepsin D., bromelin, keratinase, chymotrypsin C, pepsin C, aspergillopeptidase B, urokinase, carboxypeptidase A and B, and aminopeptidase; (2) glycoside hydrolases (cellulase which is an essential ingredient is excluded from this group) α-amylase, β-amylase, gluco amylase, invertase, lysozyme, pectinase, chitinase, and dextranase. Preferably among them are α-amylase and β-amylase. They function in acid to neutral systems, but one which is obtained from bacteria exhibits high activity in an alkaline system; (3) carboxylate ester hydrolase including carboxyl esterase, lipase, pectin esterase, and chlorophyllase. Especially effective among them is lipase.

The hydrolase other than cellulase is incorporated into the detergent composition as much as required according to the purpose. It should preferably be incorporated in an amount of 0.001 to 5 weight percent, and more preferably 0.02 to 3 weight percent, in terms of purified protein. This enzyme should be used in the form of granules made of crude enzyme alone or in combination with other components in the detergent composition. Granules of crude enzyme are used in such an amount that the purified enzyme is 0.001 to 50 weight percent in the granules. The granules are used in an amount of 0.002 to 20 and preferably 0.1 to 10 weight percent. As with cellulases, these granules can be formulated so as to contain an enzyme protecting agent and a dissolution retardant material.

Antiredeposition Agents

The composition may contain from about 0.1 to about 5 weight percent of one or more of the following compounds as antiredeposition agents: polyethylene glycol, polyvinyl alcohol, polyvinylpyrrolidone and carboxymethylcellulose.

Among them, a combination of carboxymethyl-cellulose and/or polyethylene glycol with the cellulase composition of the present invention provides for an especially useful dirt removing composition.

Bleaching Agents

The use of the, cellulase of the present invention in combination with a bleaching agent such as potassium monopersulfate, sodium percarbonate, sodium perborate, sodium sulfate/hydrogen peroxide adduct and sodium chloride/hydrogen peroxide adduct or/and a photo-sensitive bleaching dye such as zinc or aluminum salt of sulfonated phthalocyanine further improves the detergenting effects. Similarly, bleaching agents and bleach catalysts as described in EP 684 304 may be used.

Bluing Agents and Fluorescent Dyes

Various bluing agents and fluorescent dyes may be incorporated in the composition, if necessary. Suitable bluing agents and fluorescent dyes are disclosed in British Patent Application No. 2 094 826 A, the disclosure of which is incorporated herein by reference.

Caking Inhibitors

The following caking inhibitors may be incorporated in the powdery detergent: p-toluenesulfonic acid salts, xylenesulfonic acid salts, acetic acid salts, sulfosuccinic acid salts, talc, finely pulverized silica, amorphous silicas, clay, calcium silicate (such as Micro-Cell of Johns Manville Co.), calcium carbonate and magnesium oxide.

Cellulase-Activators

The activators vary depending on variety of the cellulases. In the presence of proteins, cobalt and its salts, magnesium and its salts, and calcium and its salts, potassium and its salts, sodium and its salts or monosaccharides such as mannose and xylose, the cellulases are activated and their deterging powers are improved remarkably.

Antioxidants

The antioxidants include, for example, tert-butylhydroxytoluene, 4,4'-butylidenebis(6-tert-butyl-3-methylphenol), 2,2'-butylidenebis(6-tert-butyl4-methylphenol), monostyrenated cresol, distyrenated cresol, monostyrenated phenol, distyrenated phenol and 1,1-bis(4-hydroxy-phenyl)cyclohexane.

Solubilizers

The solubilizers include, for example, lower alcohols such as ethanol, benzenesulfonate salts, lower alkylbenzenesulfonate salts such as p-toluenesulfonate salts, glycols such as propylene glycol, acetylbenzene-sulfonate salts, acetamides, pyridinedicarboxylic acid amides, benzoate salts and urea.

The detergent composition of the present invention can be used in a broad pH range from acidic to alkaline pH. In a preferred embodiment, the detergent composition of the present invention can be used in mildly acidic, neutral or alkaline detergent wash media having a pH of from above 5 to no more than about 11.5.

Aside from the above ingredients, perfumes, buffers, preservatives, dyes and the like can be used, if desired, with the detergent compositions of this invention. Such components are conventionally employed in amounts heretofore used in the art.

When a detergent base used in the present invention is in the form of a powder, it may be one which is prepared by any known preparation methods including a spray-drying method and a granulation method. The detergent base obtained particularly by the spray-drying method, agglomeration method, dry mixing method or non-tower route methods are preferred. The detergent base obtained by the spray-drying method is not restricted with respect to preparation conditions. The detergent base obtained by the spray-drying method is hollow granules which are obtained by spraying an aqueous slurry of heat-resistant ingredients, such as surface active agents and builders, into a hot space. After the spray-drying, perfumes, enzymes, bleaching agents, inorganic alkaline builders may be added. With a highly dense, granular detergent base obtained such as by the spray-drying-granulation or agglomeration method, various ingredients may also be added after the preparation of the base.

When the detergent base is a liquid, it may be either a homogeneous solution or an inhomogeneous dispersion. For removing the decomposition of carboxymethylcellulose by the cellulase in the detergent, it is desirable that carboxymethylcellulose is granulated or coated before the incorporation in the composition.

The detergent compositions of this invention may be incubated with cellulose containing fabric, for example soiled fabrics, in industrial and household uses at temperatures, reaction times and liquor ratios conventionally employed in these environments. The incubation conditions, i.e., the conditions effective for treating cellulose containing fabrics with detergent compositions according to the present invention, will be readily ascertainable by those of skill in the art. Accordingly, the appropriate conditions effective for treatment with the present detergents will correspond to those using similar detergent compositions which include known cellulases.

Detergents according to the present invention may additionally be formulated as a pre-wash in the appropriate solution at an intermediate pH where sufficient activity exists to provide desired improvements softening, depilling, pilling prevention, surface fiber removal or cleaning. When the detergent composition is a pre-soak (e.g., pre-wash or pre-treatment) composition, either as a liquid, spray, gel or paste composition, the enlarged cellulase enzyme is generally employed from about 0.0001 to about 1 weight percent based on the total weight of the pre-soak or pre-treatment composition. In such compositions, a surfactant may optionally be employed and when employed, is generally present at a concentration of from about 0.005 to about 20 weight percent based on the total weight of the pre-soak. The remainder of the composition comprises conventional components used in the pre-soak, i.e., diluent, buffers, other enzymes (proteases), and the like at their conventional concentrations.

By way of further example, stonewashing methods will be described in detail, however, the parameters described are readily modified by the skilled artisan for other applications, i.e., improving the feel and/or appearance of a fabric. The cellulose containing fabric is contacted with the cellulase containing stonewashing composition containing an effective amount of the cellulase by intermingling the treating composition with the stonewashing composition, and thus bringing the cellulase enzyme into proximity with the fabric. Subsequently, the aqueous solution containing the cellulase and the fabric is agitated. If the treating composition is an aqueous solution, the fabric may be directly soaked in the solution. Similarly, where the stonewashing composition is a concentrate, the concentrate is diluted into a water bath with the cellulose containing fabric. When the stonewashing composition is in a solid form, for example a pre-wash gel or solid stick, the stonewashing composition may be contacted by directly applying the composition to the fabric or to the wash liquor.

The cellulose containing fabric is incubated with the stonewashing solution under conditions effective to allow the enzymatic action to confer a stonewashed appearance to the cellulose containing fabric. For example, during stonewashing, the pH, liquor ratio, temperature and reaction time may be adjusted to optimize the conditions under which the stonewashing composition acts. "Effective conditions" necessarily refers to the pH, liquor ratio, and temperature which allow the cellulase enzyme to react efficiently with cellulose containing fabric, in this case to produce the stonewashed effect. Generally, the cellulases of the present invention should be utilized under conditions operable for the use of the parent cellulase(s). However, such conditions are readily ascertainable by one of skill in the art. The reaction conditions effective for the stonewashing compositions of the present invention are substantially similar to well known methods used with corresponding prior art cellulase compositions. Accordingly, it is within the skill of those in the art to maximize conditions for using the stonewashing compositions according to the present invention.

The liquor ratios during stonewashing, i.e., the ratio of weight of stonewashing composition solution (i.e., the wash liquor) to the weight of fabric, employed herein is generally an amount sufficient to achieve the desired stonewashing effect in the denim fabric and is dependent upon the process used. Preferably, the liquor ratios are from about 4:1 to about 50:1; more preferably from about 5:1 to about 20:1, and most preferably from about 10:1 to about 15:1.

Reaction temperatures during stonewashing with the present stonewashing compositions are governed by two competing factors. Firstly, higher temperatures generally correspond to enhanced reaction kinetics, i.e., faster reactions, which permit reduced reaction times as compared to reaction times required at lower temperatures. Accordingly, reaction temperatures are generally at least about 10° C. and greater. Secondly, cellulase is a protein which loses activity beyond a given reaction temperature, which temperature is dependent on the nature of the cellulase used. Thus, if the reaction temperature is permitted to go too high, the cellulolytic activity is lost as a result of the denaturing of the cellulase. While standard temperatures for cellulase usage in the art are generally in the range of 35° C. to 65° C., which conditions would also be expected to be suitable for the cellulase of the invention, the optimal temperature conditions should be ascertained according to well known techniques with respect to the specific cellulase used.

Reaction times are dependent on the specific conditions under which the stonewashing occurs. For example, pH, temperature and concentration of cellulase will all effect the optimal reaction time. Generally, reaction times are from about 5 minutes to about 5 hours, and preferably from about 10 minutes to about 3 hours and, more preferably, from about 20 minutes to about 1 hour.

In order to further illustrate the present invention and advantages thereof, the following specific examples are given with the understanding that they are being offered to illustrate the present invention and should not be construed in any way as limiting its scope.

EXAMPLE

An experiment was designed to test the premise that certain detergent formulations are optimal for the activity of alkaline cellulases. The experiments were constructed using CARDS experimental design software (obtainable from the S-Matrix Corp., Eureka Calif.) that employs a unique algorithm which combines the Scheffe model and the Quadratic model. The Scheffe model is applied to the mixture variables and the Quadratic model applies to the process variables (see Design of Experiments User Guide, version 4.0, S-Matrix, page 5.13, 1995). To establish boundary conditions, independent variables were constrained in their operating ranges as shown (Table 1) and the relative ratios of key ingredients, with respect to each other, were also defined (Table 2, Multiple Constraints).

TABLE 1

Independent Variable Settings (single constraints)

| Variable Name | Units | Type | Range/Levels |
|---|---|---|---|
| Water | % | M C | 10–65 |
| Linear Alkylbenzene Sulfonate (LAS) | % | M C | 0–40 |
| Alkyl Ethoxy Sulfate (AES) | % | M C | 0–40 |
| Alcohol Ethoxylate (AE) | % | M C | 0–40 |
| Soda ash | % | M C | 0–50 |
| Builder | % | M C | 0–50 |
| Builder Type | * | P N | phosphate or Zeolite |
| pH | pH | P C | 7.5–12 |

(M = mixture, P = process, C = continuous, N = non-numeric
The levels for each mixture variable are to calculate the percentage of a "detergent" dosed at 6 g/L.)

Multiple constraints are restrictions on the allowable combinations of the variables. The multiple constraints and their level settings are shown in Table 2:

TABLE 2

Variable Combination Restrictions (multiple constraints)

| Constraint Name | Type |
|---|---|
| Active | 10% ≦ (1)*LAS + (1)*AES + (1)*AE ≦ 40% |
| Builder | 20% ≦ (1)*soda ash + (1)*builder ≦ 50% |

These simple detergent formulations were used to study the effects on the depilling performance of an alkaline cellulase from Bacillus described in PCT Publication No. WO 96/34108 (producible by the organism deposited in the CBS as deposit number CBS 670.93) in the APT (Accelerated Performance Test). The APT is a bench scale performance test run in the Terg-o-tometer. Table 3 lists the conditions of the test.

TABLE 3

APT Test Conditions

| Parameter | Setting |
|---|---|
| Wash temperature | 40° C. |
| Wash cycle time | 2.5 hours |
| Number of cycles | 3 |
| Agitation speed | 125 rpm |
| Water hardness | 150 ppm as $CaCO_3$ (2:1 $Ca^{2+}$:$Mg^{2+}$) |
| Detergent dose | 6 g/L |
| alkaline cellulase dose (Bacillus derived) | 15 mg/L |

Depilling swatches were prepared using medium blue dyed cotton interlock knit (style 460) purchased from Tesffabrics, Inc. A 2.5 kg load of this fabric was washed 25 times in 63 liters of water using 1 gram/L of American Association of Textile Chemists and Colorists Detergent Without Brightener, 1993 formula, in a US vertical axis washing machine and tumble dried after each wash cycle.

Four prepilled swatches per sample were treated in the APT test, then evaluated by a panel of trained laboratory technicians. Panelists compared the treated swatches to a set of standard rating swatches, each numbered consecutively from 1 to 5 (5 being the least pilled and representing the best performance). Panelists assigned a value to the amount of depilling observed in the newly treated swatches. Historically, the precision for a given set of swatches is ±0.5 rating unit, and the relative error (std. dev./average) is approximately 13%.

In performing the three cycle test, the swatches are removed from the Terg pot at the end of each cycle, rinsed in a washing machine, then placed back into the Terg pot containing fresh enzyme and detergent. At the end of the third cycle rinse, the swatches are dried in a tumble dryer.

The rating results from each panelist were collected and the average rating calculated for each treatment. With the assistance of the CARD program, the data were analyzed and the regression analysis model fit the response data. The response data did not require either a primary or a secondary transformation. One treatment was found to be an outlier, and was eliminated from the analysis.

The Error %, the percent of the observed data variance that can be attributed to overall experimental error, was 13.5. An Error % between 5–50% indicates that the influence of the independent variables on the response ranges from slight to moderate. The calculated experimental error was ±0.21. Experimental error is a measure of the repeatability of the sample preparation and testing. Experimental Error (±)= (experimental error variance)$^{1/2}$.

The model equation based on the experimental design type for this experiment is:

$$Y=X1+X2+X3+X4+X5+X6+X7+X8+(X7)^2+(X1*X2)+(X1*X4)+(X2*X3)+(X2*X4)+(X3*X4)+(X3*X5)+(X4*X5)+(X5*X6)+(X7*X8)$$

Model terms not listed in the Table 4 below have no effect on the result and therefore have coefficients of zero (0). These model terms were removed from the equation. The coefficient values for the linear (single) variables are unit change multipliers, and the sign indicates the direction, positive or negative, in which the change will occur. For example, a coefficient of 0.05 means that the response will increase 0.05 units for each one unit increase in a corresponding variable. The coefficient values for the pairwise interaction terms are estimates of the dependency between the two corresponding terms $X_i$ and $X_j$, or how much the effect of one variable on the depilling response depends on the level setting of the other variable.

TABLE 4

Model Coefficients and Rankings

| Variable | Variable Name | Coefficient Value | Model Term Rank |
|---|---|---|---|
| X1 | Water | 0.0336 | 0.09 |
| X2 | LAS | 0.0327 | 0.01 |
| X3 | AES | 0.0293 | 0.15 |
| X4 | AE | 0.0395 | 0.32 |
| X5 | Soda ash | 0.0228 | 0.61 |
| X6 | builder amount | 0.0381 | 0.36 |
| X7 | pH | — | |
| X8 | builder type | −0.9812 | 1.00 |
| X1*X4 | interaction | −6.2653 | 0.95 |
| X5*X6 | interaction | 7.7391 | 0.61 |
| X7*X8 | interaction | 0.9602 | 0.96 |

Figure 2:
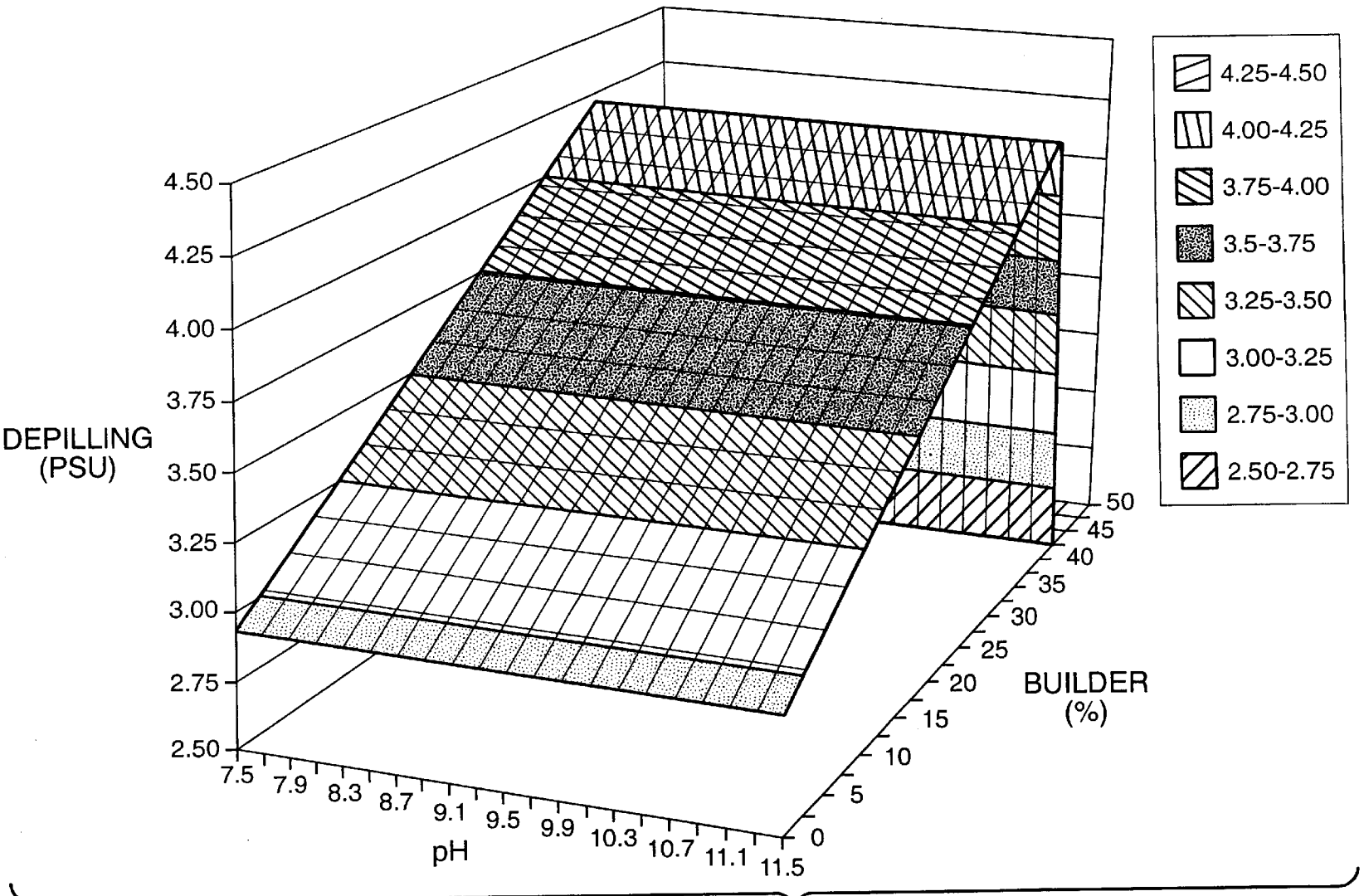
FIG. 2 shows the effect of pH and phosphate type builder on depilling.
Figure 3:
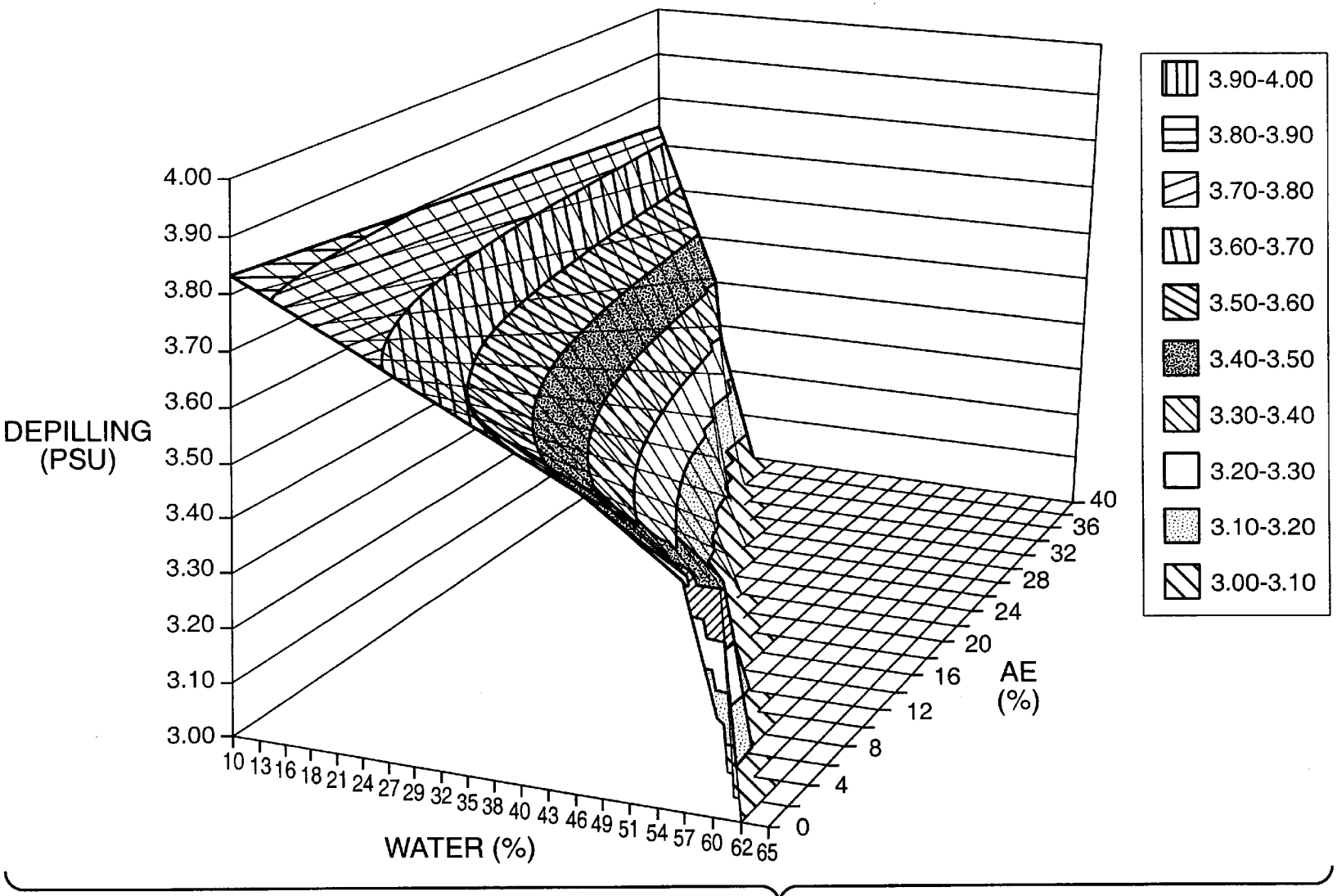
FIG. 3 shows the effect of water and alcohol ethoxylate on depilling.

Analysis of the data reveals that there are three different types of effect terms that are relevant to this experiment; namely, linear effects, interaction effects and non-numeric/numeric interaction effects. A review of the coefficient values and model term rankings listed in Table 4 shows which specific terms have the greatest influence on depilling response. Those terms with rankings shown in bold have the greatest effect across their experimental range. The non-numeric term "builder type" has the strongest influence on depilling response, as indicated by its ranking of 1.00, and the coefficient for this variable is also negative. This means that the average depilling response drops by 0.98 rating units when zeolite is used as the builder relative to the average depilling response that would be obtained when STPP is used as the builder. The non-numeric/numeric interaction between pH and "builder type" is the next strongest effector of depilling response. In this case, the choice of builder at a given pH influences depilling response. This is best visualized in FIGS. 1 and 2. In FIG. 1, pH effects depilling response when zeolite is chosen as the builder type, but in FIG. 2 pH does not effect depilling when STPP is chosen as the builder type. The interaction between the linear terms Water and AE has a strong negative effect on depilling response. FIG. 3 shows how changes in the amounts of both Water and AE affect depilling response. Depilling decreases as the amount of water increases and/or the amount of AE increases. The greatest depilling response is observed under conditions of relatively low water and AE levels.

The revised model, with each coefficient determined from the experimental data, can be used to determine an optimum detergent formula for maximum depilling response. Due to the influence of several complex variable effects, multiple optimizations were conducted using different level settings as the starting points. For example, in one such optimization run the level settings for each variable were all set to zero (0) and the pH set at 10, while in another optimization run the level settings were set to very high values. These different starting points produced different optimum formulae, as listed in Table 5.

TABLE 5

Optimum Formulae for Maximum Depilling Response

| Variable Name | Formula 1 | Formula 2 | Formula 3 | Formula 4 |
|---|---|---|---|---|
| Water (X1) | 10% | 40% | 10% | 40% |
| LAS (X2) | 0 | 10 | 0 | 10 |
| AES (X3) | 0 | 0 | 0 | 0 |
| AE (X4) | 40 | 0 | 40 | 0 |
| Soda ash (X5) | 17 | 17 | 17 | 17 |
| Builder amt. (X6) | 33 | 33 | 33 | 33 |
| pH (X7) | 10 | 10.9 | 12 | 12 |
| Builder type (X8) | phosphate (STPP) | phosphate (STPP) | Zeolite | Zeolite |
| Predicted Response | 4.1 | 3.8 | 4.1 | 3.8 |

The predicted responses were surprising because it would have been expected that the responses for zeolite detergents would have been lower than responses for the phosphate detergents based on the high ranking of the "builder type" term. Upon further consideration, it appears that other variable effects, simple and/or complex, may override a single term and that the optimum composition is dependent on specific quantities of the various components, in combination, rather than their effect singly.

The cellulase described in PCT Publication No. WO 96/34108 was evaluated in each of the above formulae shown in Table 4 using the APT conditions listed in Table 3 on Text Conditions. Test results are shown in Table 6.

TABLE 6

Results of Validation Test

| | Formula 1 | Formula 2 | Formula 3 | Formula 4 |
|---|---|---|---|---|
| Actual result | 4.75 | 4.75 | 1 | 1 |
| Predicted result | 4.1 | 3.8 | 4.1 | 3.8 |

As shown above, major detergent components, namely surfactants and builders, have a strong influence on the depilling performance of alkaline cellulose. From these data, the formula in which alkaline cellulase will offer the maximum depilling benefit should contain between 5–15% water, 30–40% AE, 15–20% soda ash, and 30–35% builder which is a phosphate type builder, and the wash liquor pH should be maintained between 8 and 11.5.

Further, formulae 1 and 3, for example, contained different builder types yet had the same predicted response as listed in Table 5. FIGS. 1 and 2 suggest that phosphate-containing formulae produce a greater depilling response, especially at lower pH. Tests showed that the alkaline cellulase in formulae containing STPP performed significantly better than alkaline cellulase in formulae containing zeolite, as shown in Table 6. We suspect that actual depilling differed from predicted responses due to the influence of pH, complex interactions among detergent components which reduced or masked the effects of individual components, or a combination of both.

Depilling performance of alkaline cellulase appears to correlate with builder concentration and, in the case of zeolite, coordinate with pH. Builder type has the strongest influence on depilling response. Average depilling response drops when zeolite is used as the builder relative to the response that would be obtained when STPP is used as the builder. Additionally, performance is sensitive to alcohol ethoxylate yet remarkably insensitive to LAS. FIG. 3 shows the greatest depilling response is observed under conditions of low water and low alcohol ethoxylate levels.

I claim:

1. A textile treatment composition consisting essentially of: (a) 3–25% water by weight; (b) 25–45% alcohol ethoxylate by weight; (c) 5–30% soda ash by weight; (d) 20–50% of a phosphate type builder by weight; and (e) an alkaline cellulase.

2. The composition according to claim 1, wherein said composition has a pH of between 8 and 11.5 upon dilution in a wash liquor.

3. The composition according to claim 1, wherein said alkaline cellulase is of bacterial origin.

4. The composition according to claim 3, wherein said bacterial cellulase is from Bacillus.

5. The composition according to claim 1, wherein said composition is a liquid detergent.

6. The composition according to claim 1, wherein said composition is a gel detergent.

7. The composition according to claim 3, further comprising a fabric softener.

8. The composition according to claim 3, wherein said composition is a pre-wash composition.

9. The composition according to claim 1, wherein said alkaline cellulase is from Actinomycete.

10. The composition according to claim 1, wherein said composition is a stonewashing composition.

11. The composition according to claim 1, wherein said composition is a detergent composition.

12. The composition according to claim 11, wherein said composition is a concentrated detergent.

13. The composition according to claim 11, wherein the cellulase is in a concentration of from 5 ppm to about 20,000 ppm of detergent.

14. A textile treatment composition consisting essentially of; (a) 5–20% of water by weight; (b) 25–45% of an alcohol ethoxylate by weight; (c) 10–25% of soda ash by weight; (d) 25–40% of a phosphate type builder by weight; and (e) an alkaline cellulase.

15. A textile treatment composition consisting essentially of, (a) 5–15% of water by weight; (b) 30–40% of an alcohol ethoxylate by weight; (c) 15–20% of soda ash by weight; (d) 30–35% of a phosphate type builder by weight; and (e) an alkaline cellulase.

16. A textile treatment composition consisting essentially of: (a) 3–25% water by weight; (b) 25–45% alcohol ethoxylate by weight; (c) 5–30% soda ash by weight; (d) 20–50% of a phosphate type builder by weight; (e) an alkaline cellulase and (f) an enzyme selected from the group consisting of a protease, an amylase, a lipase, a hemicellulase, an esterase and a pectinase.

17. A method of treating textiles comprising the steps of: (a) preparing an aqueous solution; (b) adding to said aqueous solution a detergent composition consisting essentially of (i) 3–25% of water by weight; (ii) 25–45% of an alcohol ethoxylate by weight; (iii) 5–30% soda ash by weight; (iv) 20–50% of a phosphate type builder by weight; and (v) an alkaline cellulase to make a textile treatment solution; and (c) adding a cellulose containing textile garment, yarn or fabric to said textile treatment solution and allowing said textile treatment solution to contact said garment, yarn or fabric for a sufficient time and under sufficient conditions to treat said textile.

* * * * *